US008998593B2

(12) United States Patent
Vicars

(10) Patent No.: US 8,998,593 B2
(45) Date of Patent: Apr. 7, 2015

(54) FLUID END ASSEMBLY

(75) Inventor: Berton L. Vicars, Ruidoso, NM (US)

(73) Assignee: J-Mac Tool, Inc., Fort Worth, TX (US)

( * ) Notice: Subject to any disclaimer, the term of this patent is extended or adjusted under 35 U.S.C. 154(b) by 699 days.

(21) Appl. No.: 12/659,084

(22) Filed: Feb. 24, 2010

(65) Prior Publication Data

US 2011/0206546 A1 Aug. 25, 2011

(51) Int. Cl.

| | |
|---|---|
| ***F04B 39/10*** | (2006.01) |
| ***F04B 53/10*** | (2006.01) |
| ***F04B 39/14*** | (2006.01) |
| ***F04B 53/22*** | (2006.01) |
| ***F04B 53/00*** | (2006.01) |

(52) U.S. Cl.
CPC ..... *F04B 53/007* (2013.01)

(58) Field of Classification Search
USPC ..... 417/559, 568, 571, 454
See application file for complete search history.

(56) References Cited

U.S. PATENT DOCUMENTS

| | | | | | |
|---|---|---|---|---|---|
| 2,841,092 | A | * | 7/1958 | Whiteman et al. | 417/568 |
| 3,049,082 | A | * | 8/1962 | Barry | 92/165 R |
| 3,276,390 | A | * | 10/1966 | Bloudoff et al. | 92/61 |
| 3,373,695 | A | * | 3/1968 | Yohpe | 417/569 |
| 3,427,988 | A | * | 2/1969 | Schmieman et al. | 417/569 |
| 3,489,098 | A | * | 1/1970 | Roth et al. | 92/153 |
| 3,801,234 | A | * | 4/1974 | Love et al. | 417/454 |
| 3,891,356 | A | * | 6/1975 | Christ | 417/437 |
| 4,456,440 | A | * | 6/1984 | Korner | 417/540 |
| 4,508,133 | A | * | 4/1985 | Hamid | 137/68.22 |
| 4,520,837 | A | * | 6/1985 | Cole et al. | 137/68.23 |
| 4,527,961 | A | * | 7/1985 | Redwine et al. | 417/454 |
| 4,758,135 | A | * | 7/1988 | Woodward et al. | 417/559 |
| 4,768,933 | A | * | 9/1988 | Stachowiak | 417/454 |
| 4,771,801 | A | * | 9/1988 | Crump et al. | 137/68.26 |
| 4,861,241 | A | * | 8/1989 | Gamboa et al. | 417/454 |
| 4,878,815 | A | * | 11/1989 | Stachowiak | 417/63 |
| 4,940,261 | A | * | 7/1990 | Somers Vine | 285/112 |
| 5,073,096 | A | * | 12/1991 | King et al. | 417/454 |
| 5,102,312 | A | * | 4/1992 | Harvey | 417/571 |
| 5,253,987 | A | * | 10/1993 | Harrison | 417/566 |
| 5,362,215 | A | * | 11/1994 | King | 417/455 |
| 5,605,449 | A | * | 2/1997 | Reed | 417/454 |
| 5,636,975 | A | * | 6/1997 | Tiffany et al. | 417/454 |
| 6,382,940 | B1 | | 5/2002 | Blume | |
| 6,544,012 | B1 | * | 4/2003 | Blume | 417/559 |
| 6,623,259 | B1 | * | 9/2003 | Blume | 417/559 |
| 6,910,871 | B1 | * | 6/2005 | Blume | 417/571 |
| 7,186,097 | B1 | * | 3/2007 | Blume | 417/454 |
| 7,341,435 | B2 | * | 3/2008 | Vicars | 417/360 |
| 2003/0202892 | A1 | * | 10/2003 | Aly Abdel El Rahman Orfi et al. | 417/415 |

(Continued)

*Primary Examiner* — Alexander Comley
(74) *Attorney, Agent, or Firm* — James E. Walton

(57) ABSTRACT

A fluid end assembly including a pump housing with a number of interior passages for the flow of fluids. The housing has a plunger bore with a closed inner end and an open outer end. A suction passage intersects the plunger bore. A discharge passage intersects both the plunger bore and the suction passage such that the discharge passage, the suction passage, and the plunger bore radiate outwardly from their point of intersection to define a shape resembling a "Y". A connector passage branches from the discharge passage. An outlet passage intersects the connector passage and passes through the pump housing at right angles to the plunger bore. A reciprocating plunger is located in the plunger bore. A suction valve is located in the suction passage. A discharge valve is located in the discharge passage. A fluid supply manifold is pivotally secured to the housing and is in fluid communication with the suction passage.

16 Claims, 10 Drawing Sheets

(56) References Cited

U.S. PATENT DOCUMENTS

| | | | | |
|---|---|---|---|---|
| 2003/0235508 | A1* | 12/2003 | Vicars | 417/360 |
| 2004/0170507 | A1* | 9/2004 | Vicars | 417/360 |
| 2004/0234404 | A1* | 11/2004 | Vicars | 417/571 |
| 2005/0201881 | A1* | 9/2005 | Jensen et al. | 417/529 |
| 2005/0249615 | A1* | 11/2005 | Jezek | 417/415 |
| 2005/0276708 | A1* | 12/2005 | Miller | 417/437 |
| 2006/0002806 | A1* | 1/2006 | Baxter et al. | 417/539 |
| 2008/0138224 | A1* | 6/2008 | Vicars | 417/545 |
| 2010/0135833 | A1* | 6/2010 | Schwegman | 417/454 |

* cited by examiner

FLUID END ASSEMBLY

FIELD OF THE INVENTION

The invention relates generally to pumps having pumping chamber pressure-responsive fluid distributors and, more particularly, to such pumps having distributors positioned opposite the end face of a pumping member.

BACKGROUND OF THE INVENTION

It is difficult to economically produce hydrocarbons from low permeability reservoir rocks. Oil and gas production rates are often boosted by hydraulic fracturing, a technique that increases rock permeability by opening channels through which hydrocarbons can flow to recovery wells. During hydraulic fracturing, a fluid is pumped into the earth under high pressure (sometimes as high as 50,000 PSI) where it enters a reservoir rock and cracks or fractures it. Large quantities of proppants are carried in suspension by the fluid into the fractures. When the pressure is released, the fractures partially close on the proppants, leaving channels for oil and gas to flow.

Specialized pumps are used to deliver fracture fluids at sufficiently high rates and pressures to complete a hydraulic fracturing procedure or "frac job." These pumps are usually provided with fluid ends having both reciprocating plungers that place fluids under pressure and valves that control fluid flow to and from the plungers. Fluid ends have many parts that are releasably fastened to one another so that they can be easily repaired or replaced. It is the connections between the parts and the supporting features for the valves that tend to weaken a fluid end, limiting its pressure rating, and making it susceptible to corrosion, leaks, and cracks under high, cyclical stresses. Thus, fluid ends sometimes fail under load prematurely.

In an effort to increase pressure ratings and decrease failure rates, "Y-type" fluid ends have been proposed by oilfield pump manufacturers. Y-type fluid ends reduce concentrated stresses in the body of a fluid end by increasing the angles at which the principal flow channels within the body intersect one another to about 120°, reducing cyclical loading. Few of the proposed Y-type designs have seen widespread use or commercial success since they have been difficult and costly to make and equally difficult to service in the field. A continuing need, therefore, exists for a strong and reasonably priced, Y-type fluid end that delivers fracture fluids to reservoir rocks at very high rates and pressures.

SUMMARY OF THE INVENTION

In light of the problems associated with the known fluid ends used in high-pressure pumps that are prone to fatigue failures, it is a principal object of the invention to provide a fluid end assembly having a Y-type configuration that is extremely durable and has a long working life. Worn parts of my fluid end assembly can easily be replaced.

It is another object of the invention to provide a fluid end assembly of the type described that is relatively compact in size and is easy to lift.

It is a further object of the invention to provide a Y-type fluid end assembly whose internal passageways for fluid flow have short lengths, minimizing pressure losses as fluid moves through the assembly. The passageways are also configured to further reduce pressure losses and vibrations. For example, the outlet passages of many fluid ends direct pumped fluids through one or more discharge valves whereas my outlet passage is positioned to the side of the discharge valve so as not to interfere with the operation of the discharge valve. Therefore, my fluid end assembly is more efficient and smooth-running than the known designs.

Still another object of the invention is to provide a fluid end assembly that features new, turbulence-reducing suction and discharge valves. The valves reduce pressure losses as fluids move through the fluid end assembly thereby increasing the operational efficiency of the fluid end assembly. The valves are configured such that they can be accessed through passages opening to the exterior of the fluid end assembly for easy repair and replacement, conserving a user's time and resources. It is another object of the invention to provide a fluid end assembly of the type described with a suction valve positioned above a discharge valve so that fluid flow through the fluid end is generally downward. The hydrostatic head of the pumped fluid in the assembly minimizes the likelihood of cavitation as the plunger reciprocates and, also, causes the fluid end to operate with little vibration. Further, positioning the discharge valve in a subordinate location permits the assembly to be cleared of fluid with a few strokes of the plunger and avoids the risk of cracking the housing of the assembly should any fluid trapped inside the assembly freeze. If desired, my fluid end assembly can be inverted to operate with the discharge valve located above the suction valve.

It is an additional object of the invention to provide a fluid end assembly that features a novel plunger assembly that can be quickly replaced in the event that it becomes worn.

It is an object of the invention to provide improved elements and arrangements thereof in a fluid end assembly for the purposes described which is relatively lightweight in construction, inexpensive to manufacture, and fully dependable in use.

It is a further object of the invention to provide a fluid end assembly featuring a hinge for the attachment of a suction manifold. The hinge permits access to the interior of the fluid end and retains the manifold in a position for ready reattachment. Reattachment is made by means of VICTAULIC clamps.

Briefly, my fluid end assembly achieves the intended objects by featuring a pump housing with a number of interior passages for the flow of fluids. A plunger bore, a suction passage and a discharge passage intersect one another and are arranged in the form of a "Y". A connector passage branches from the discharge passage. An outlet passage intersects the connector passage and passes through the pump housing. A reciprocating plunger is located in the plunger bore. A suction valve is located in the suction passage. A discharge valve is located in the discharge passage. A fluid supply manifold is pivotally secured to the housing and is in fluid communication with the suction passage. Reciprocating the plunger in the plunger bore draws fluid from the manifold and delivers it to the outlet passage with the suction and discharge valves ensuring that pumped fluid does not back up in the housing.

The foregoing and other objects, features and advantages of my fluid end assembly will become readily apparent upon further review of the following detailed description of the preferred embodiments as illustrated in the accompanying drawings.

BRIEF DESCRIPTION OF THE DRAWINGS

My fluid end assembly is more readily understood with reference to the accompanying drawings, in which.

Similar reference characters denote corresponding features consistently throughout the accompanying drawings.

DETAILED DESCRIPTION OF THE PREFERRED EMBODIMENTS OF THE INVENTION

Figure 1:
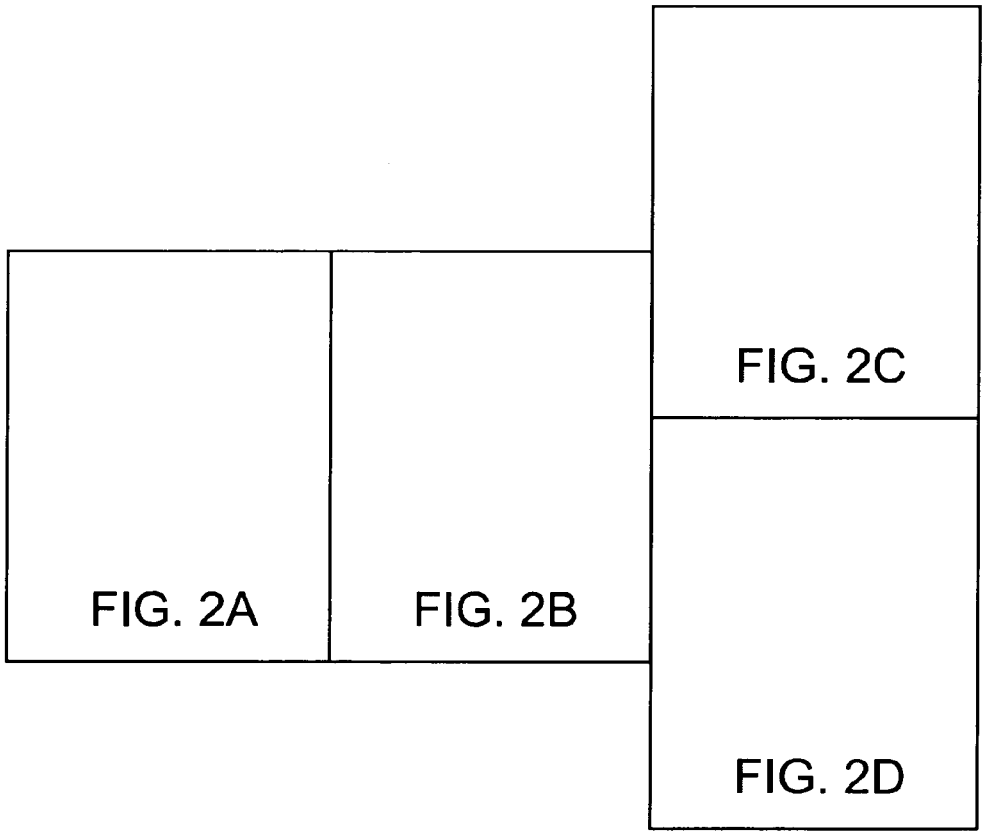
FIG. 1 is a schematic view showing the relative positions of the four drawing sheets carrying FIGS. 2A, 2B, 2C, and 2D.

Referring now to FIGS. 1 and 2 of the drawings, a first embodiment of my fluid end assembly is shown at 10. Fluid end assembly 10 includes a pump housing 12 having a plunger bore 14 within which a plunger 16 reciprocates. At its inner end, plunger bore 14 terminates in a pumping chamber 18 that is supplied with fluid from above by a suction passage 20 in pump housing 12. Fluid pressurized by plunger 16 exits pumping chamber 18 downwardly through a discharge passage 22 in pump housing 12. A suction valve 24 in suction passage 20 establishes the one-way flow of fluid from a supply manifold 28 into pumping chamber 18. A discharge valve 26 in discharge passage 22 sets up the one-way flow of fluid from pumping chamber 18 into an outlet passage 30 for release from fluid end assembly 10.

Pump housing 12 is a steel block of suitable size and shape. To lower its weight and increase its strength, housing 12 is provided with a plunger section 32 of reduced height that contains the outer end of plunger bore 14 and is adapted for attachment to the power end of a high-pressure pump 34 by a number of stay rods 36. A suction section 38, containing suction passage 20, is integrally formed with plunger section 32 and extends forwardly and upwardly from plunger section 32. Similarly, a discharge section 40, containing discharge passage 22, is integrally formed with plunger section 32 and suction section 38 and extends forwardly and downwardly from plunger section 32. Suction and discharge sections 38 and 40 generally taper from their inner ends to their outer ends.

Plunger bore 14 is provided within pump housing 12 along a centerline A. At its outer end, plunger bore 14 is widened and partly threaded at 42 to receive a compressible, packing unit 44 and a rotatable gland nut 46 that provide a fluid-tight seal around plunger 16. A number of radial apertures 45 in the gland nut 46 permit gland nut to be easily grasped by a spanner wrench (not shown) and screwed into plunger bore 14. A lubricating port 48 in plunger section 32 permits a lubricating oil to flow under the influence of gravity to plunger 16 at a point between packing unit 44 and gland nut 46 so that plunger 16 can be reciprocated without binding.

Suction passage 20 intersects the top of pumping chamber 18 and has a centerline B. Centerline B is coplanar with centerline A and intersects centerline A at a reference point Z in pumping chamber 18 to define a first obtuse angle $\alpha$. Suction passage 20 extends from the bottom to the top of suction section 38. Suction passage 20 has a bottom part 20*a* of relatively small diameter and a helically threaded, top part 20*b* of large diameter, with each of parts 20*a* and 20*b* measuring about half of the length of suction passage 20. The top of part 20*a* forms a deck 50 upon which a suction valve seat and guide assembly 52, being a feature of suction valve 24, rests. The innermost portion of deck 50, located closest to centerline B, is oriented at right angles to centerline B for optimally transferring forces from valve seat and guide assembly 52 to pump housing 12 so as to reduce the likelihood of fatigue-induced cracks forming in housing 12 at this location.

Discharge passage 22 intersects the bottom of pumping chamber 18 and has a third centerline C. Centerline C is coplanar with centerlines A and B that it intersects at reference point Z where there is a second obtuse angle $\lambda$ formed between centerlines A and C. Additionally, discharge passage 22 has a top part 22*a* of relatively small diameter and a helically threaded, bottom part 22*b* of large diameter. The bottom of part 22*a* forms a deck 54 upon which a discharge valve seat 56, being a feature of discharge valve 26, rests. The portion of deck 54 closest to centerline C is oriented at right angles to centerline C for optimally transferring forces from valve seat 56 to pump housing 12 in a manner that reduces the likelihood of fatigue-induced cracks forming in housing 12 at this location.

Figure 2A:
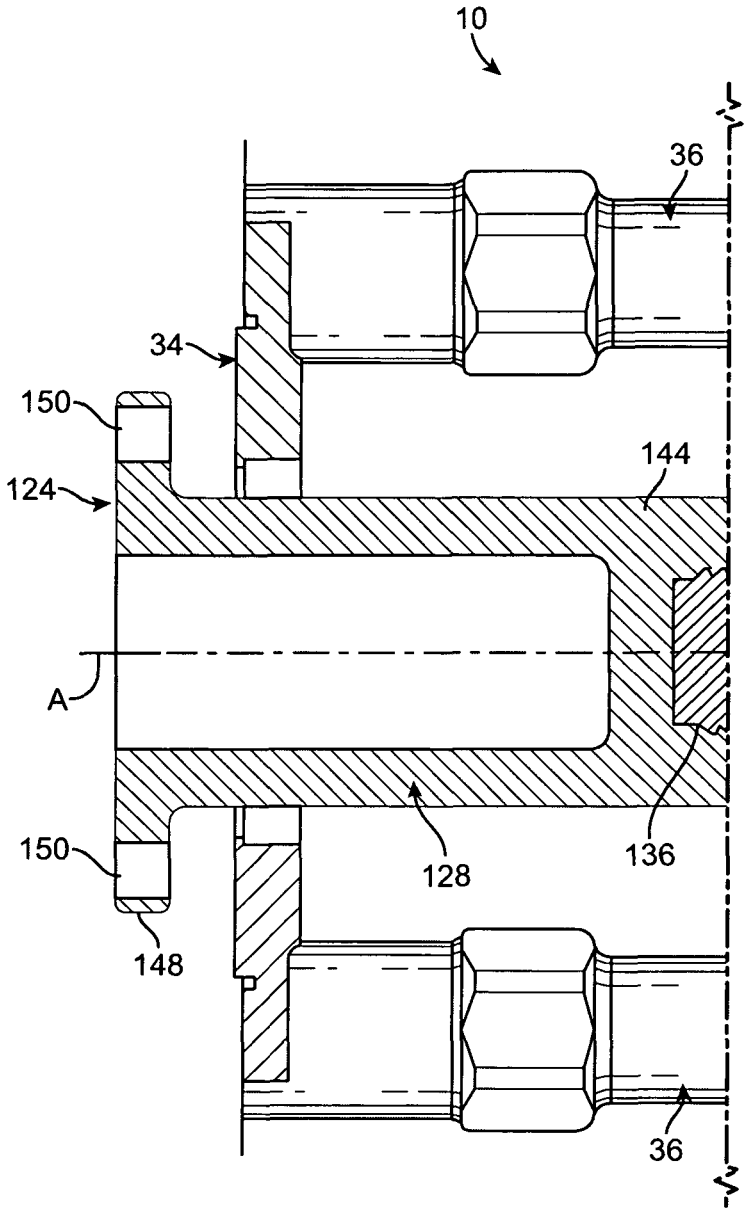
FIG. 2A is a cross-sectional view of the left portion of a first embodiment of my fluid end assembly.
Figure 2B:
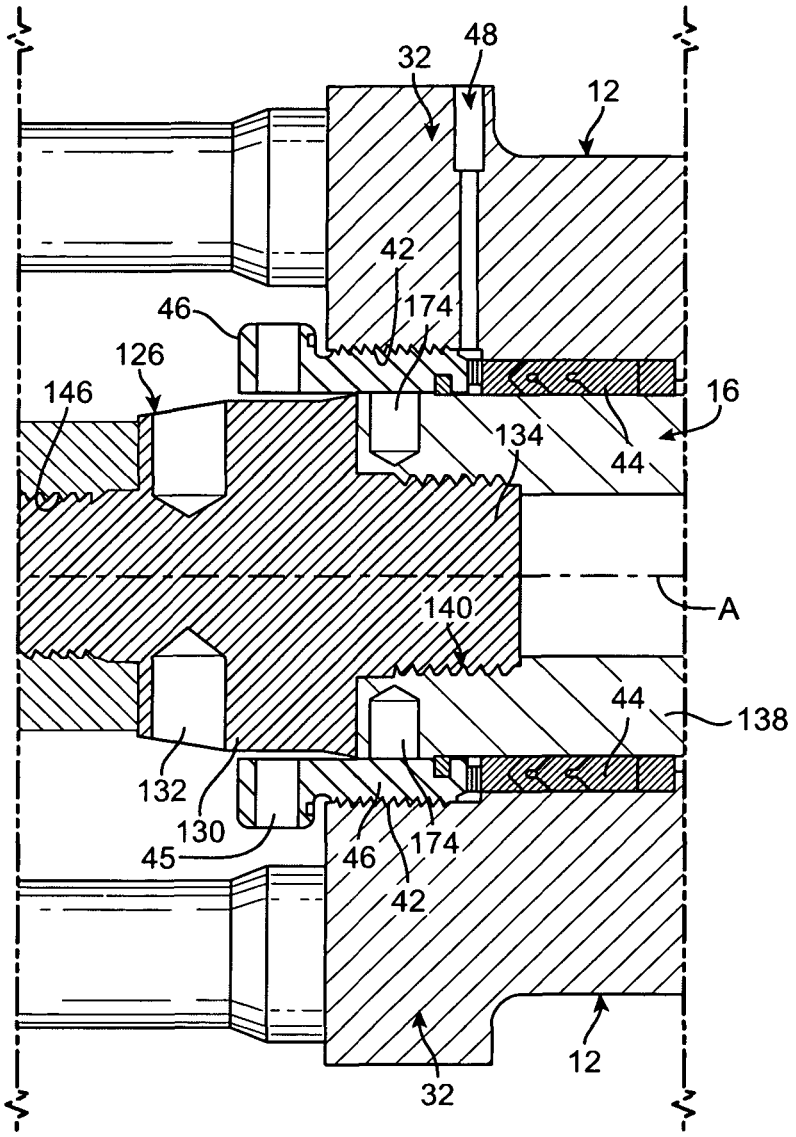
FIG. 2B is a cross-sectional view of the central portion of the first embodiment of my fluid end assembly.
Figure 2C:
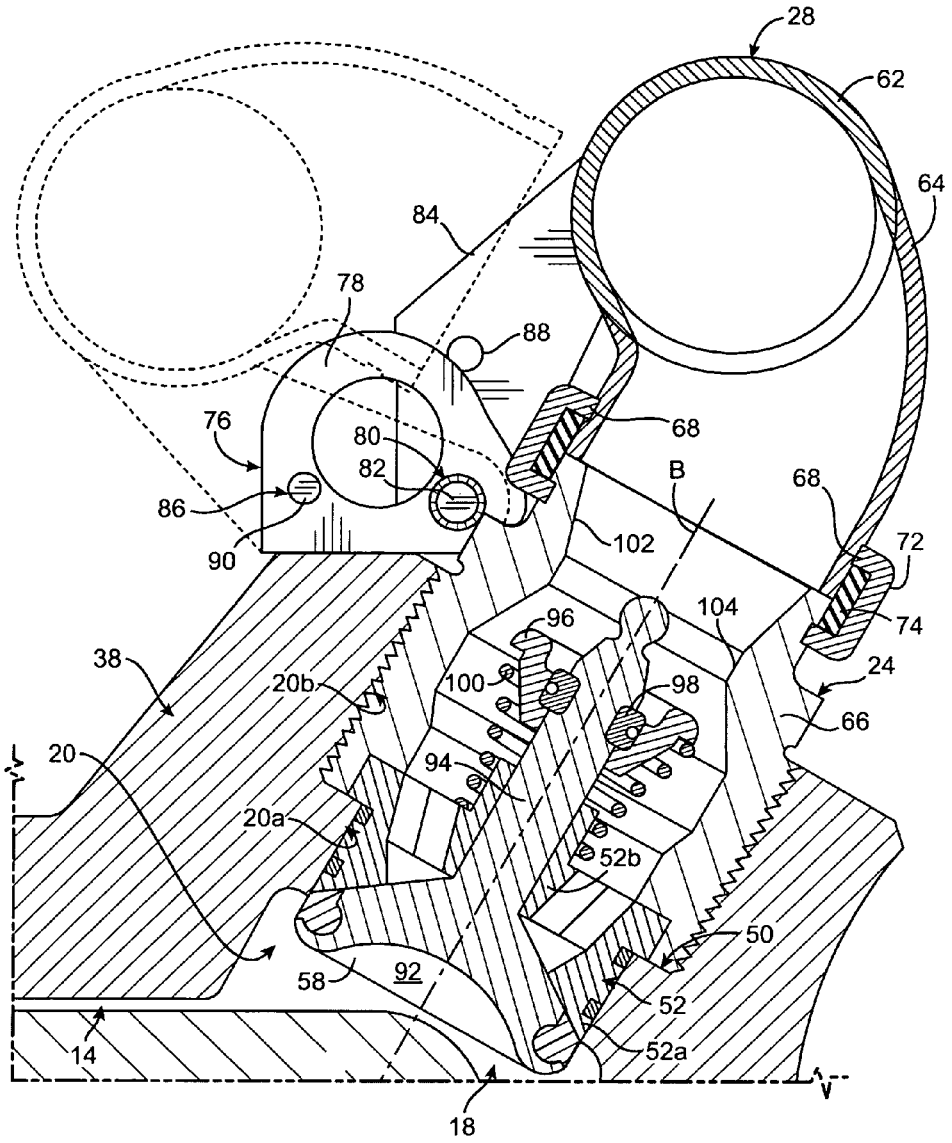
FIG. 2C is a cross-sectional view of the upper, right portion of the first embodiment of my fluid end assembly.
Figure 2D:
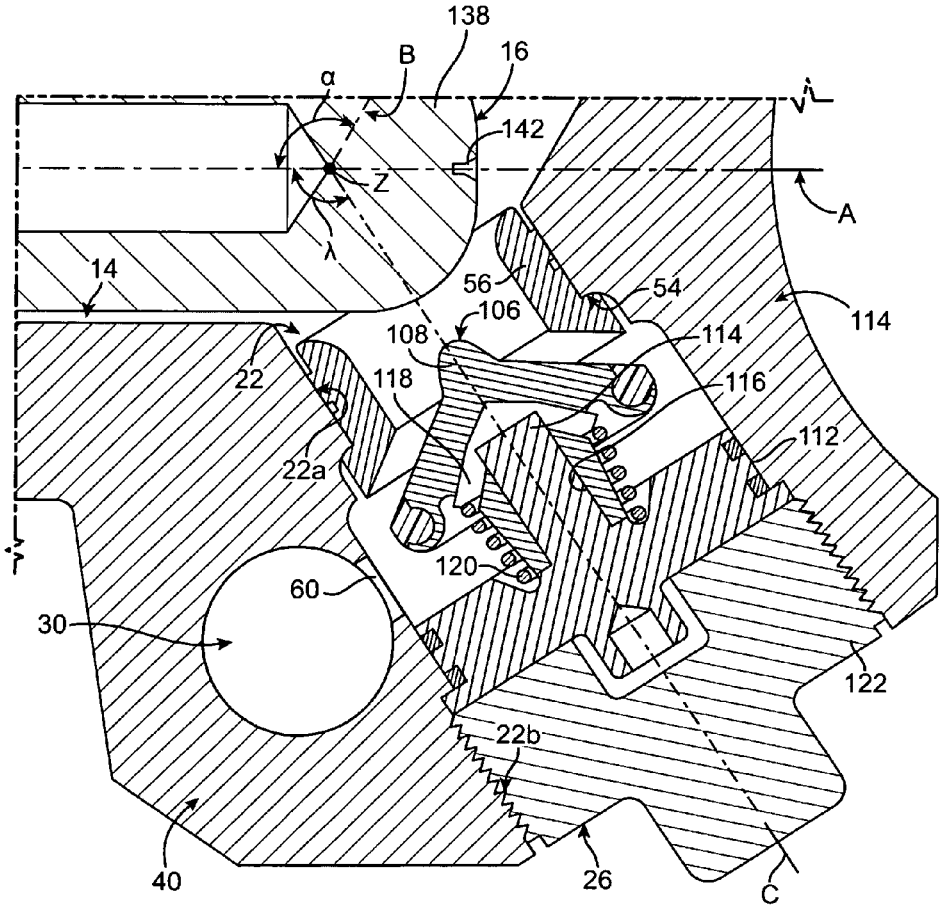
FIG. 2D is a cross-sectional view of the lower right portion of the first embodiment of my fluid end assembly.

Reference point Z is placed on centerline A at a location that facilitates the movement of fluid from suction passage 20 into pumping chamber 18 and from pumping chamber 18 into discharge passage 22 as plunger 16 reciprocates from its innermost point of travel to the right of point Z in FIG. 2D to its outermost point of travel to the left of point Z in FIG. 2D. (At its innermost point of travel, illustrated in FIG. 2D, plunger 16 has passed point Z to move into both suction passage 20 and discharge passage 22. Suction valve piston 58 is provided with a concave cross section to avoid contact with plunger 16 and so is discharge valve seat 56.) Obtuse angle $\alpha$, measuring about 120°, is somewhat less than obtuse angle $\lambda$, measuring about 125°, to accommodate outlet passage 30 in discharge section 40. The resulting Y-shaped configuration offered by the intersections of plunger bore 14, suction passage 20, discharge passage 22 and their associated centerlines A, B and C reduces stresses within pump housing 12 during the use of fluid end assembly 10 to minimize the likelihood of pump housing 12 cracking over time and maximize the service life of assembly 10.

Outlet passage 30 passes through discharge section 40, extending from one end of discharge section to the other. A connector passage 60 intersects outlet passage 30 at right angles to place discharge passage 22 in fluid communication with outlet passage 30. To either end, or both ends, of discharge section 40 is connected one or more conduits (not shown) for carrying 2 0 pressurized fluid away from outlet passage 30 and fluid end assembly 10. This pressurized fluid is used in oilfield applications to fracture subterranean rock formations. Placing outlet passage 30 away from discharge valve 26 limits the transverse or lateral flow of fluid through the discharge valve 26, especially in fluid end assemblies constructed with multiple, parallel sets of plungers 16 and valves 24 and 26. Discharge valve 26, therefore, runs without interference from turbulent flow through outlet passage 30 thereby resulting in a smoother-running and more efficient fluid end assembly 10.

Supply manifold 28 includes a tubular body 62 whose opposite ends are connected to a fluid source when assembly 10 is operated. A tubular connector 64 extends downwardly from tubular body 62 to engage the open top of valve retainer 66 of suction valve 24. The bottom of connector 64 is provided with a peripheral slot 68 and the top of valve retainer 66 is provided with a similar, peripheral slot 70. Slots 68 and 70 accommodate a VICTAULIC coupling body 72 of well-known construction for the quick and easy connection of valve retainer 66 to manifold 28. Within body 72 is positioned a VICTAULIC rubber seal 74 to prevent fluid leaks from body 72.

To permit the easy servicing of suction valve 24 without the need to fully disengage manifold 28 from assembly 10, one or more hinges 76 join manifold 28 to pump housing 12. Each hinge 76 has a mounting bracket 78 secured by one or more threaded fasteners (not shown) to pump housing 12. Mounting bracket 78 has a transverse aperture 80 that accommodates a hinge pin 82. The inner end of a swing arm 84 is pivotally attached by hinge pin 82 to mounting bracket 78. The outer end of swing arm 84 is affixed to tubular body 62. When VICTAULIC coupling body 72 is removed from assembly 10, manifold 28 is free to pivot 90° on hinge 76 to the broken line position seen in FIG. 2B.

Supply manifold 28 can be locked in a pivoted position to permit suction valve 24 to be easily serviced. To this end, a second transverse aperture 86 is provided in mounting bracket 78 adjacent first transverse aperture 80 and a third transverse aperture 88, positioned for registration with second aperture 86 when manifold 28 is in a pivoted position, is provided in swing arm 84. Locking manifold 28 in the pivoted position is afforded by extending a locking pin 90 through registered apertures 86 and 88.

Mounting bracket 78 is provided in the form of a loop or ring to serve as a lifting eye for fluid end assembly 10. By grasping bracket 78 with suitable lifting hook or chain, assembly 10 can be elevated while mounted upon power end 34 or not. Thus, assembly 10 can be safely and easily transported from place to place.

Suction valve 24 is described fully in my co-pending patent application, Ser. No. 12/453,461, filed in the U.S. Patent and Trademark Office on May 12, 2009, and incorporated for all purposes herein. By way of review, however, valve 24 includes valve seat and guide assembly 52 tightly fitted into the bottom part 20*a* of suction passage 20. A piston 58 moves within assembly 52 to control the flow of fluid through suction passage 20. Piston 58 has a head 92 for engaging the seat portion 52*a* of assembly 52 and a stem 94 extending upwardly from head 92 through the guide portion 52*b* of assembly 52. A valve keeper 96 is fitted upon the top of stem 94 and is retained there by a split ring 98. A compressed spring 100 is positioned between guide portion 52*b* and keeper 96 for normally retaining head 92 in engagement with seat portion 52*a* so as to prevent fluid flow through passage 20. Externally, helically threaded, valve retainer 66 is screwed into top part 20*b* of suction passage 20 to retain the balance of valve 24 within pump housing 12 and provide for the attachment of valve 24 to manifold 28. Valve retainer 66 has a tapered inner passageway 102 with a small-diameter, orifice portion 104 that serves to maintain a fluid velocity through fluid end assembly 10 that is sufficient to prevent proppant particles carried by a pumped fluid from dropping from suspension and blocking suction valve 24. Of course, the relatively large, outer diameter of valve retainer 66 permits valve seat and guide assembly 52, piston 58, spring 100, etc., to be accessed from the exterior of pump housing 12 (once manifold 28 is pivoted out of the way and retainer 66 is disengaged from housing 12) making the servicing of suction valve 24 a breeze.

Pump housing 12 is substantially strengthened by helically threading the entirety of the top part 20*b* of suction passage 20. The coextensive threads on the exterior of valve retainer 66 distribute pressure loads evenly to the pump housing 12 thereby inhibiting the formation of cracks in the pump housing 12 at the bottom of top part 20*b* adjacent seat deck 50 caused by cyclical loading of fluid end assembly 10.

Discharge valve 26 is described fully in my co-pending patent application, Ser. No. 12/453,452, filed in the U.S. Patent and Trademark Office on May 12, 2009, and incorporated for all purposes herein. Discharge valve 26 includes valve seat 56 positioned in top part 22*a* of discharge passage 22 and a reciprocating piston 106 for controlling the flow of fluid through passage 22. Piston 106 has a head portion 108 for engaging valve seat 56 and a hollow, stem portion 110 extending downwardly from head portion 108. A valve guide 112 is positioned below piston 106 in passage 22 and has a guide rod 114 that projects upwardly into a longitudinal socket 116 provided in stem portion 110 where it is slidably received. A number of radial apertures 118 penetrate the bottom of stem portion 110 to equalize the pressures in passage 22 and socket 116. A compressed spring 120 is disposed between the valve guide 112 and head portion 108 to normally press head portion 108 into engagement with seat 56. A valve retainer 122 is screwed into the bottom part 22*b* of passage 22 to retain valve 26 within pump housing 12.

Plunger assembly 124 is fully described in my co-pending patent application, Ser. No. 12/588,269, filed in the U.S. Patent and Trademark Office on Oct. 9, 2009, and incorporated for all purposes herein. Plunger assembly 124 includes a pony rod adapter 126, plunger 16 releasably attached to pony rod adapter 126, and a pony rod 128 being releasably attached to pony rod adapter 126.

Pony rod adapter 126 has a first cylindrical body 130 and a number of apertures 132 penetrating first cylindrical body 130 for engagement by a first spanner wrench (not shown). A first helically threaded pin 134 is affixed to first cylindrical body 130 and projects from one of its ends. A second helically threaded pin 136 is affixed to first cylindrical body 130 and projects from the other of its ends.

Plunger 16 has a second cylindrical body 138 for reciprocating within a pumping chamber 18. Second cylindrical body 138 has a first outer end with a first helically threaded bore 140 for threadably receiving first helically threaded pin 134. Second cylindrical body 138 also has a first inner end with a socket 142 useful for supporting for body 138 at the time of its manufacture. A number of radial holes 174 are provided around the outer end of plunger 16 for engagement by a second spanner wrench (not shown). In use, with the first spanner wrench engaged with pony rod adapter 126, the second spanner wrench grasps plunger 16 and applies the torque needed to unscrew plunger 16 from pony rod adapter 126.

Pony rod 128 has a third cylindrical body 144 for reciprocating into, and out of, power end 34. Third cylindrical body 144 has a second inner end with a second helically threaded bore 146 for threadably receiving second helically threaded pin 136. Third cylindrical body 144 also has a second outer end. A peripheral flange 148 is affixed to, and extends outwardly from, the second outer end. Peripheral flange 148 is provided with a number of holes 150 through which an equal number of threaded fasteners (not shown) are extended for connecting pony rod 128 to the reciprocating components of the power end 34.

Fluid end assembly 10 pressurizes fluid by means of the reciprocating action of plunger 16. Valves 24 and 26 permit fluid pressurized by plunger 16 to move only in one direction from manifold 28 to outlet passage 30. The Y-shaped configuration of bore 14 and passages 20 and 22 in addition to the thick, tapered walls provided to plunger section 32, suction section 38, and discharge section 40 provide pump housing 12 with a construction that is robust and not prone to fail under the cyclical loading developed by plunger 16. Should plunger 16, valves 24 and 26, packing unit 44, gland nut 46, or plunger assembly 124 ever require servicing, they are easy to repair or replace with ordinary tools and without major disassembly of the fluid end assembly 10.

Figure 3:
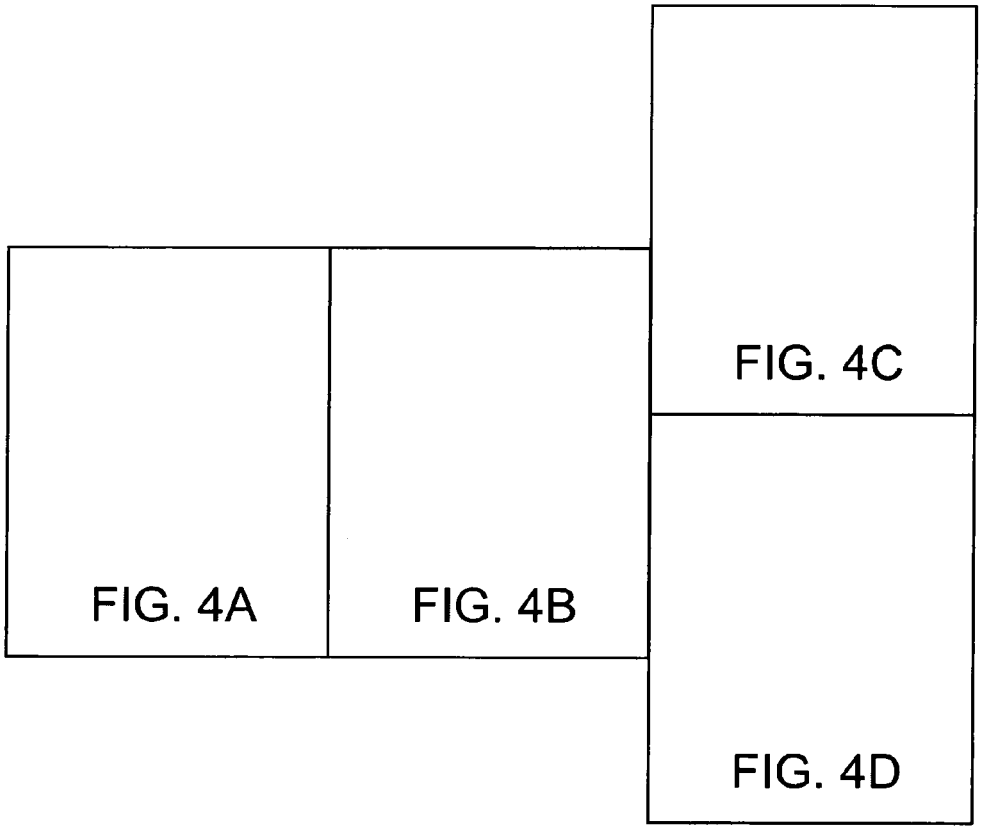
FIG. 3 is a schematic view showing the relative positions of the four drawing sheets carrying FIGS. 4A, 4B, 4C, and 4D.

Referring now to FIGS. 3 and 4 of the drawings, a second embodiment of my fluid end assembly is shown at 410. Fluid end assembly 410 is substantially the same as fluid end assembly 10 except that a suction valve 424 and a discharge valve 426, and the passages 420 and 422 for the valves 424 and 426, have been modified somewhat. These modifications are believed to further strengthen valves 424 and 424 and fluid end assembly 410.

Fluid end assembly 410 includes a pump housing 412 having a plunger bore 414 within which a plunger 416 reciprocates. At its inner end, plunger bore 414 terminates in a pumping chamber 418 that is supplied with fluid by a suction passage 420 in pump housing 412. Fluid pressurized by plunger 416 exits pumping chamber 418 through a discharge passage 422 in pump housing 412 located opposite suction passage 420. A suction valve 424 in suction passage 420 permits the one-way flow of fluid from a supply manifold 428 to pumping chamber 418. A discharge valve 426 in discharge passage 422 allows that one-way flow of fluid from chamber 418 into an outlet passage 430 for release from assembly 410.

Pump housing 412 is a steel forging. Housing 412 has a plunger section 432 that contains the outer end of plunger bore 414 and is adapted for attachment to the power end of a high-pressure pump 434 by a number of stay rods 436. A suction section 438, containing suction passage 420, is integrally formed with plunger section 432 and extends forwardly and upwardly from plunger section 432. Similarly, a discharge section 440, containing discharge passage 422, is integrally formed with plunger section 432 and suction section 438 and extends forwardly and downwardly from plunger section 432. Suction and discharge sections 438 and 440 taper from their inner ends to their outer ends.

Plunger bore 414 is provided within pump housing 412 along a first centerline A'. At its outer end, plunger bore 414 is widened and partly threaded at 442 to receive a packing unit 444 and a rotatable gland nut 446 that, together, provide a fluid-tight seal around plunger 416. A lubricating port 448 in plunger section 432 permits a liquid lubricant to flow to plunger 416 at a point between packing unit 444 and gland nut 446.

Suction passage 420 intersects plunger bore 414 and has a second centerline B' that is coplanar with centerline A' and intersects centerline A' at a reference point Z' to define a first obtuse angle $\alpha'$. Passage 420 extends from the bottom to the top of suction section 438. Passage 420 has a tapered, bottom part 420*a*, increasing in diameter from bottom to top with sides sloping about 15° relative to centerline A'. Passage 420 also has a helically threaded, top part 420*b* of relatively large diameter.

Passage 420 has a deck 450 that serves as a guide for installing seat 452 of suction valve 424. The top of part 420*a*, being of smaller diameter than the bottom of part 420*b*, forms deck 450 in housing 412. The innermost portion of deck 450, located closest to centerline B', is oriented at right angles to centerline B'. Since no portion of valve 424, described hereinbelow, rests upon deck 450 there is little likelihood of fatigue-induced cracks forming in or around deck 450.

Discharge passage 422 intersects both plunger bore 414 and suction passage 420 and has a third centerline C'. Centerline C' is coplanar with centerlines A' and B' that it intersects at reference point Z' so as to define a second obtuse angle $\lambda'$. Additionally, passage 422 has a tapered, top part 422*a*, increasing in diameter from top to bottom with sides sloping about 15° relative to centerline C'. Passage 422 also has a medial part 422*b* of somewhat greater diameter than the bottom of part 422*a*. Finally, passage 422 has a helically threaded, bottom part 422*c* having a diameter greater than that of part 422*b*.

Passage 422 has a deck 454 that serves as a guide for installing seat 456 of discharge valve 426. The bottom of part 422*a*, being of smaller diameter than the top of part 422*b*, forms deck 454 in housing 412. The innermost portion of deck 450, located closest to centerline C', is oriented at right angles to centerline C'. Since no portion of valve 426, described hereinbelow, rests upon deck 454 there is little likelihood of fatigue-induced cracks forming in or around deck 454.

Figure 4A:
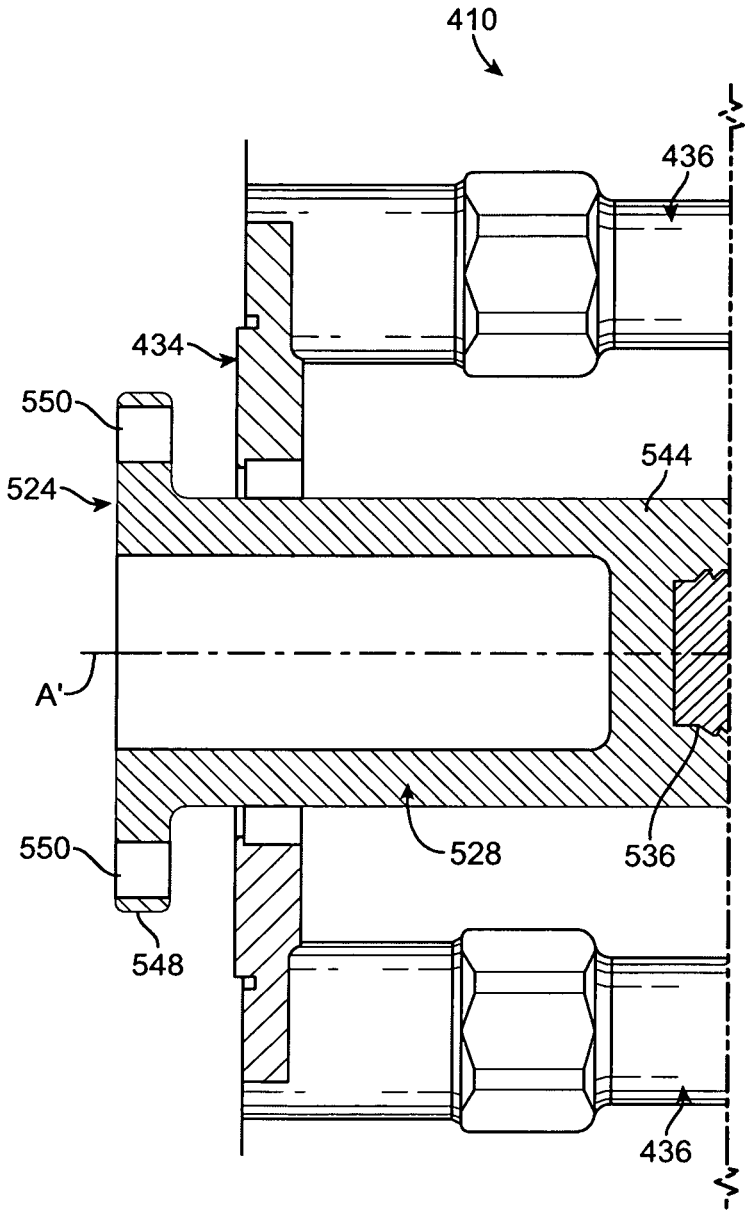
FIG. 4A is a cross-sectional view of the left portion of a second embodiment of my fluid end assembly.
Figure 4B:
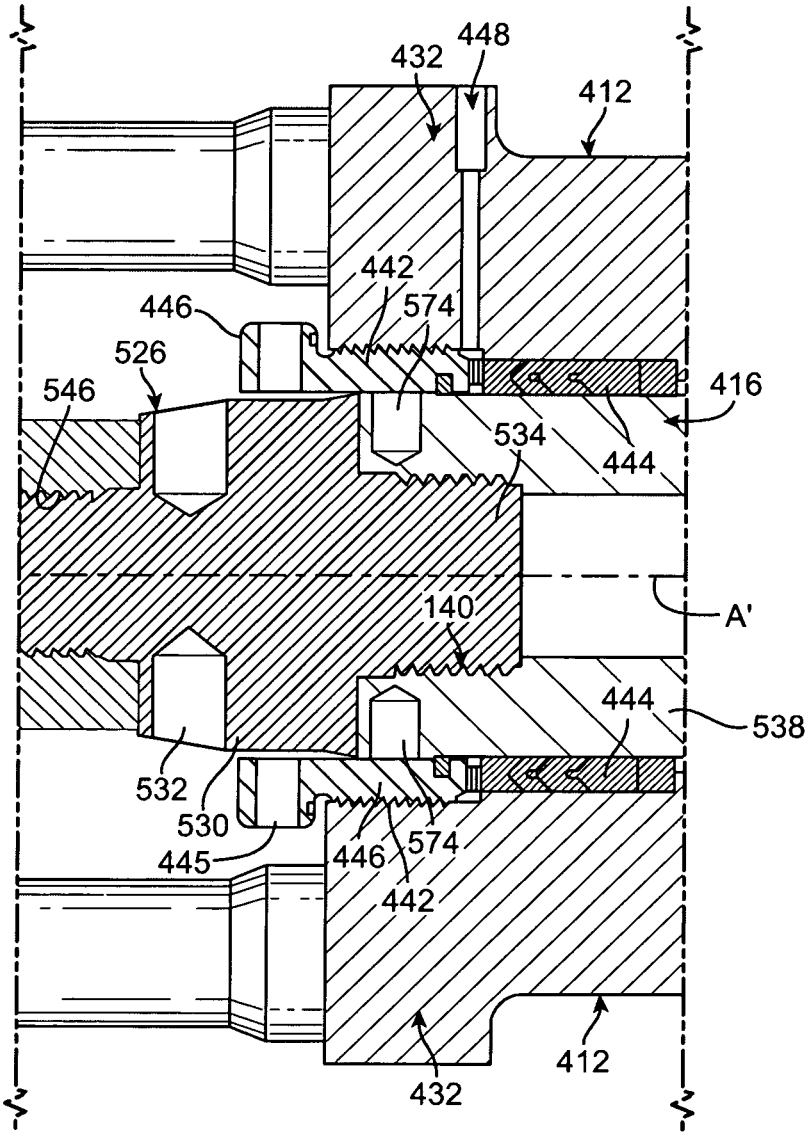
FIG. 4B is a cross-sectional view of the central portion of the second embodiment of my fluid end assembly.
Figure 4C:
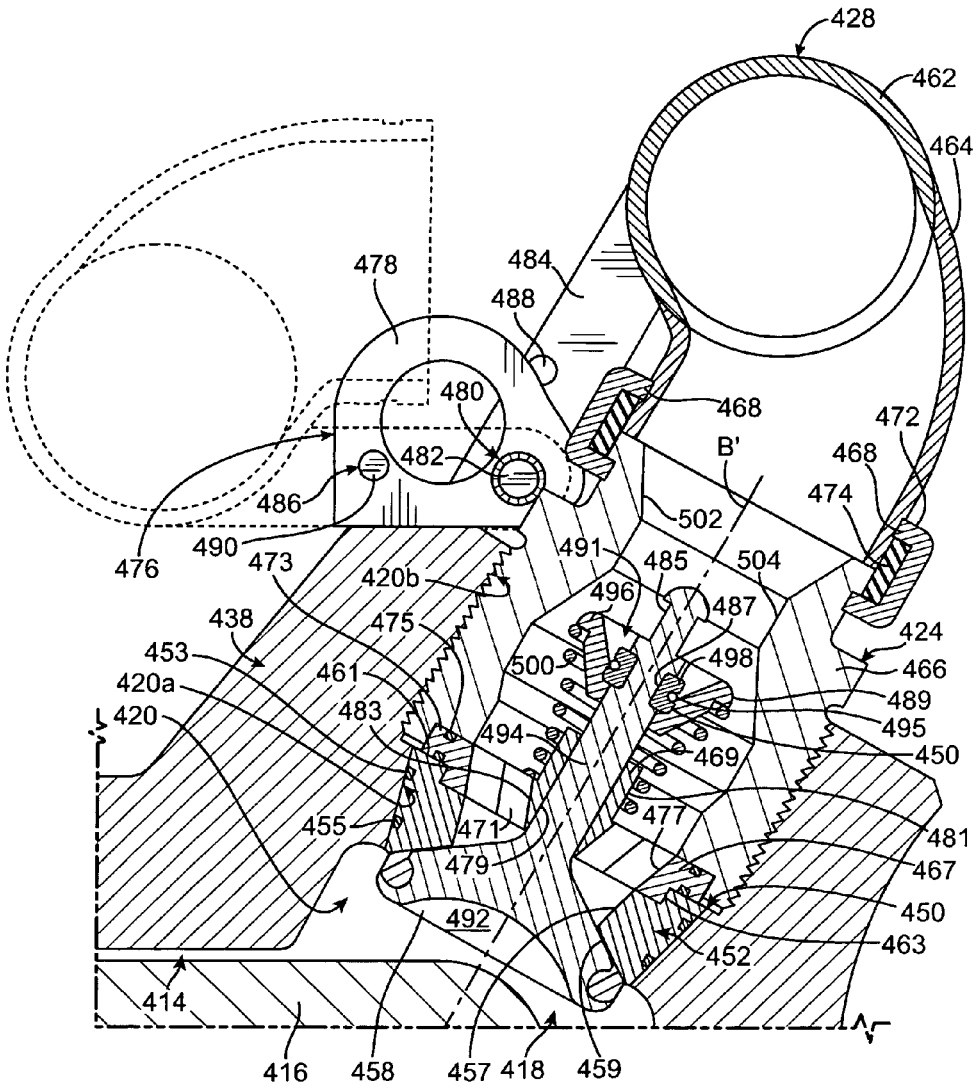
FIG. 4C is a cross-sectional view of the upper, right portion of the second embodiment of my fluid end assembly.
Figure 4D:
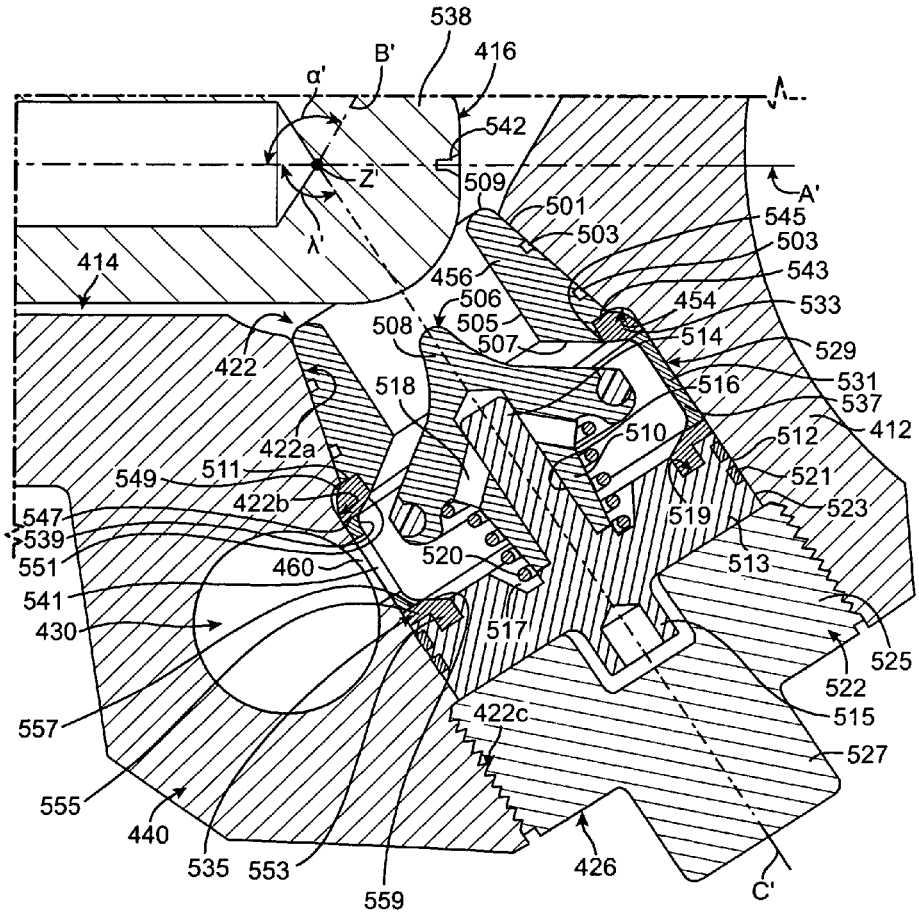
FIG. 4D is a cross-sectional view of the lower right portion of the second embodiment of my fluid end assembly.

Reference point Z' is placed on centerline A' at a location that facilitates the movement of fluid from pumping chamber 418 into discharge passage 422 as plunger 416 reciprocates from its innermost point of travel to the right of point Z' in FIGS. 4B and 4C to its outermost point of travel to the left of point Z' in FIGS. 4B and 4C. (At its innermost point of travel, illustrated in FIGS. 4B and 4C, plunger 416 passes point Z' to pass into both suction passage 420 and discharge passage 422 and penetrates suction valve 424 and discharge valve 426. Suction valve piston 458 is provided with a concave cross section to avoid contact with plunger 416 and discharge valve seat 456 is similarly open.) Obtuse angle $\alpha'$, measuring about 120°, is somewhat less than obtuse angle $\lambda'$, measuring about 125°, to accommodate outlet passage 430. The resulting Y-shaped configuration offered by the intersections of plunger bore 414, suction passage 420, discharge passage 422 and their associated centerlines A', B' and C' reduces stresses within pump housing 412 during use.

Outlet passage 430 extends through discharge section 440. A connector passage 460 intersects outlet passage 430 at right angles to place discharge passage 422 in fluid communication with outlet passage 430. To either end of discharge section 440 can be connected one or more conduits (not shown) to carry pressurized fluid away from outlet passage 430 and assembly 410. Placing outlet passage 430 away from discharge valve 426 in an unconventional manner keeps the flow of fluid over and around the discharge valve 426 to a minimum, limiting vibrations.

Supply manifold 428 includes a tubular body 462 whose opposite ends are connected to a fluid source when assembly 410 is in operation. A tubular connector 464 extends downwardly from tubular body 462 to engage the open top of valve retainer 466 of suction valve 424. The bottom of connector 464 is provided with a peripheral slot 468 and the top of valve retainer 466 is provided with a similar, peripheral slot 470. Slots 468 and 470 accommodate a VICTAULIC coupling body 472 for the connection of valve retainer 466 to manifold 428. Within body 472 is positioned a VICTAULIC rubber seal 474.

To permit the easy servicing of suction valve 424 without the need to fully disengage manifold 428 from assembly 410, one or more hinges 476 join manifold 428 to pump housing 412. Each hinge 476 has a mounting bracket 478 secured by one or more threaded fasteners (not shown) to pump housing 412. Mounting bracket 478 has a transverse aperture 480 that accommodates a hinge pin 482. The inner end of a swing arm 484 is pivotally attached by hinge pin 482 to mounting bracket 478. The outer end of swing arm 484 is affixed to tubular body 462. When VICTAULIC coupling body 472 is removed from assembly 410, manifold 428 can pivot 90° on hinge 476 to the broken line position seen in FIG. 4C.

Supply manifold 428 can be secured in a pivoted position to permit suction valve 424 to be easily serviced. To this end, a second transverse aperture 486 is provided in mounting bracket 478 adjacent first transverse aperture 480 and a third transverse aperture 488, positioned for registration with second aperture 486 when manifold 428 is in a pivoted position, is provided in swing arm 484. Locking manifold 428 in the pivoted position is afforded by extending a locking pin 490 through registered apertures 486 and 488.

Mounting bracket 478 is provided in the form of a loop or ring to serve as a lifting eye for fluid end assembly 410. By grasping bracket 478 with suitable lifting apparatus, assembly 410 can be elevated while mounted upon power end 434 or not. Thus, assembly 410 can be safely and easily transported.

Suction valve 424 includes a funnel-shaped, valve seat 452 positioned in the bottom part 420*a* of suction passage 420. As shown, seat 452 has an outside surface 453 that slopes downwardly and inwardly at an angle of about 15° relative to axis B' and fits flush against bottom part 420*a*. A pair of O-ring seals 455 is inset into outside surface 453 to prevent fluid from leaking around seat 452. Seat 452 also has an inside surface 457 that is substantially parallel to outside surface 453 that channels flowing fluid toward an opening of predetermined size in the bottom of seat 452 that serves as an orifice to regulate the rate of flow of fluids through suction valve 424. The bottom surface 459 of seat 452 slopes upwardly and inwardly toward axis B' at an angle of about 45°, and the top surface 461 of seat 452 is oriented at right angles to axis B'. Around the inside of top surface 461, seat 452 is provided with a peripheral channel 463.

A valve guide 465 is positioned atop valve seat 452. Valve guide 465 includes an outer ring 467 and an inner ring 469 connected together by a number of radial fins 471. Outer ring 467 fits snugly within peripheral channel 463 and extends upwardly therefrom. Ring 467 has a circumferential flange 473 that projects outwardly from the top thereof to engage top surface 461. A pair of O-ring seals 475 is inset into the top and bottom of flange 473 to prevent fluid leaks around ring. Ring 467 has a inside surface 477 that slopes downwardly and inwardly at a somewhat shallower angle than inside surface 457 to direct fluid toward valve seat 452.

Inner ring 469 is centrally positioned within outer ring 467. Ring 469 has an interior surface 479 for slidably engaging the stem 494 of a piston 458 and an exterior surface 481. Extending outwardly from the bottom of exterior surface 481 is a radial flange 483 that serves as an abutment for the top of a compressed spring 500.

Inner ring 469 and outer ring 467 are connected together by a number of fins 471 integrally formed therewith. Fins 471 radiate outwardly from flange 483 at 120° intervals and connect to inside surface 481. Fins 471 are relatively thin and present a minimal impediment to the flow of fluids through valve 424.

Piston 458 moves against valve seat 452 to control the flow of fluid through suction passage 420. Piston 458 has a head 492 for engaging seat 452 and a stem 494 extending upwardly from head 492 and through inner ring 469. A peripheral groove 485 is provided around the free end of stem 494 for grasping piston 458 from the exterior of fluid end assembly 410 during installation of valve 424. Another peripheral groove 487 is provided in stem 494 a short distance below groove 485.

A valve keeper 496 is fitted over the top of stem 494 and has a conical configuration. Keeper 496 is conical and has an exterior diameter that decreases from its top to its bottom. Extending outwardly from the top of keeper 496 is a peripheral rim 489 that serves as an abutment for the top of spring 500.

A recess 491 is provided in the top of keeper 496 for snugly receiving split ring 498 that is fitted into groove 487 in stem 494. To ensure that split ring 498 does not slide from recess 491, split ring 498 is outfitted with an inset O-ring 495. O-ring 495 serves as a safety feature to wedge keeper 496 and split ring 498 together even if spring 500 breaks thereby reducing the likelihood that piston 458 will come loose during the use of valve 424 and engage plunger 416.

Compressed spring 500 is positioned between flange 483 and rim 489 for normally retaining head 492 in engagement with seat 452 to prevent fluid flow through passage 420. Spring 500 is, however, resilient enough to permit the piston 458 to move away from seat 452 and permit the entry of fluid into pumping chamber 418 when plunger 416 creates a partial vacuum in pumping chamber 418.

Externally helically threaded, valve retainer 466 is screwed into top part 420*b* of suction passage 420 to retain the balance of valve 424 within pump housing 412 and provide for the attachment of valve 424 to manifold 428. Valve retainer 466 has a tapered inner passageway 502 with a small-diameter, orifice portion 504 that serves to maintain a fluid velocity through fluid end assembly 510 that is sufficient to prevent proppant from dropping from suspension and preventing the normal operation of suction valve 424. Of course, the relatively large, outer diameter of valve retainer 466 permits valve seat and guide assembly 452, piston 458, spring 500, etc., to be accessed from the exterior of pump housing 412 (once manifold 428 is pivoted out of the way and retainer 466 is disengaged from housing 412) making servicing of suction valve 424 a breeze.

Pump housing 412 is substantially strengthened by helically threading the entirety of the top part 420*b* of suction passage 420. The coextensive threads on the exterior of valve retainer 466 distribute pressure loads evenly to the pump housing 412 inhibiting the formation of cracks in the pump housing 412 at the bottom of top part 420*b* adjacent seat deck 450.

Discharge valve 426 includes a funnel-shaped, valve seat 456 positioned in the top part 422*a* of discharge passage 422. Seat 456 has an outside surface 501 that slopes downwardly and outwardly at an angle of about 15° relative to axis C' and fits flush against top part 422*a*. A pair of O-ring seals 503 is inset into outside surface 501 to prevent fluid from leaking around seat 456. Seat 456 also has an inside surface 505 that is substantially parallel to axis C' that channels flowing fluid toward outlet passage 430. The bottom surface 507 of seat 456 slopes upwardly and inwardly toward axis C' at an angle of about 45°, and the top surface 509 of seat 456 is rounded to receive pressurized fluid from pumping chamber 418. Around the outside of bottom surface 507, seat 456 is provided with a peripheral channel 511. Peripheral channel 511 has a depth sufficient to bring the bottom of outside surface 501 flush with seat deck 454.

Valve 426 has a reciprocating piston 506 controlling the flow of fluid through passage 422. Piston 506 has a head portion 508 for engaging bottom surface 507 and a hollow, stem portion 510 extending downwardly from head portion 508. A number of radial apertures 518 penetrate the bottom of stem portion 510.

A valve guide 512 is positioned below piston 506 in passage 422. Valve guide 512 has a disk-like base plate 513 that fits snugly into the middle portion 422*b* of discharge passage 422. A guide rod 514 is affixed to, and projects upwardly from, the top of base plate 513 into a longitudinal socket 516 provided in stem portion 510 where rod 514 is slidably received. An internally threaded socket 515 is affixed to, and projects downwardly from, the bottom of base plate 513. Socket 515 is provided for grasping valve guide 512 to remove it from pump housing 412 during the servicing of valve 426.

The top of base plate 513 is provided with a recess 517 that extends around the bottom of guide rod 514. Recess 517 extends about half way into base plate 513 and receives the bottom of a compressed spring 520. Recess 517 has a sloping side wall to prevent the bunching of spring 520 when such is compressed by the movement of piston 506.

A peripheral channel 519 is provided in the top of base plate 513. Channel 519 is spaced outwardly from recess 517 and has about one-half the depth thereof. The width of channel 519 is about the same as its depth.

A pair of O-ring seals 521 is inset into the outside surface 523 of base plate 513. O-ring seals 521 are closely spaced and are intended to prevent leaks from discharge passage 422 past valve guide 512.

A valve retainer 522 keeps valve 426 within pump housing 412. Retainer 522 has an externally helically threaded plug 525 that is screwed into the bottom part 422*c* of passage 422. A tightening stem 527 of hexagonal cross section is affixed to, and projects downwardly from, the bottom of plug 525. A wrench (not shown) grasps stem 527 so as to rotate retainer 522.

A compressed spring 520 is disposed between the valve guide 512 and head portion 508 to normally press head portion 508 into engagement with seat 456. Spring 520 loosely encircles stem portion 510. Spring is seated, at its top end against the bottom of head 508 and at its bottom end, in recess 517.

Discharge valve 426 has a liner assembly 529, disposed between valve seat 456 and valve guide 512, for minimizing the erosion of the pump housing 412 by pressurized, abrasive, proppant-bearing fluids. Liner assembly 529 has three parts: a liner 531, a liner holder 533 that engages valve seat 456, and a liner retainer 535 that engages valve guide 512. Together, the parts of liner assembly 529 closely cover the center part 422*b* of discharge passage 422. Furthermore, liner 531, liner holder 533 and liner retainer 535 have a combined height and stiffness that is sufficient to permit a firm, compressive force, generated by fully screwing retainer 522 into part 422*c*, to be imparted to valve seat 456. Thus, valve seat 456 cannot wobble in part 422*a* since it is wedged in place.

Liner 531 is a ring having an outer surface 537 of constant diameter being slightly less than the diameter of part 422*b* and an inner surface 539 that arcs inwardly at its top and bottom so as to thicken and strengthen liner 531 in these areas. An aperture 541 is provided in liner 531 for registration with connector passage 460. Aperture 541 has the same diameter as connector passage 460 so as to not impede flow into outlet passage 430.

Liner holder 533 is sized for snug positioning in peripheral channel 511. Liner holder 533 has a top surface 543 and an inside surface 545 that bear against valve seat 456. Liner holder 533 also has a bottom surface 547 that bears against liner 531. A convex, outside surface 549, having a radius of curvature that is less than that of seat deck 454 so as to not contact seat deck 454, connects top surface 543 to bottom surface 547. (By avoiding contact with seat deck 454, no additional stress is imparted to seat deck 454 by the addition of liner assembly 529 to fluid end assembly 410.) A medial surface 551 connects inside surface to bottom surface 547 and provides a smooth flow transition between bottom surface 507 and inner surface 539 of liner 531.

Liner retainer 535 has a ring portion 553 that is sized for snug positioning in peripheral channel 519. A peripheral flange portion 555 is affixed to, and projects outwardly from, the top of ring portion 553. Flange portion 555 has a top surface 557 that engages the bottom of liner 531. Ring portion 553 has a top surface 559 that slopes downwardly and inwardly from top surface 557 so as to provide a smooth flow transition between liner 531 and the top of base plate 513.

Plunger assembly 524 includes a pony rod adapter 526, plunger 516 releasably attached to pony rod adapter 526, and a pony rod 528 being releasably attached to pony rod adapter 526. Pony rod adapter 526 has a first cylindrical body 530 and a number of apertures 532 penetrating first cylindrical body 530. A first helically threaded pin 534 is affixed to first cylindrical body 530 and projects from one of its ends. A second helically threaded pin 536 is affixed to first cylindrical body 530 and projects from the other of its ends. Plunger 416 has a second cylindrical body 538 for reciprocating within a pumping chamber 418. Second cylindrical body 538 has a first outer end with a first helically threaded bore 540 for threadably receiving first helically threaded pin 534. Second cylindrical body 538 also has a first inner end with a polygonal socket 542 for receiving a plunger key (not shown). Pony rod 528 has a third cylindrical body 544 for reciprocating into, and out of, power end 434. Third cylindrical body 544 has a second inner end with a second helically threaded bore 546 for threadably receiving second helically threaded pin 536. Third cylindrical body 544 also has a second outer end. A peripheral flange 548 is affixed to, and extends outwardly from, the second outer end. Peripheral flange 548 is provided with a number of holes 550 through which an equal number of threaded fasteners (not shown) are extended for connecting pony rod 528 to the reciprocating components of the power end 434.

A number of radial holes 574 are provided around the outer end of plunger 416 for engagement by a spanner wrench. The wrench grasps plunger 416 at the holes 574 and applies torque and pulling force as needed to remove plunger 416 from pump housing 412.

Fluid end assembly 410 produces useful work by pressurizing fluid by means of the reciprocating action of plunger 416. Valves 424 and 426 permit fluid pressurized by plunger 416 to move only in one direction from manifold 428 to outlet passage 430. The Y-shaped configuration of bore 414 and passages 420 and 422 in addition to the thick, tapered walls provided to plunger, suction and discharge sections 432, 438 and 440 pump housing 412 with a construction that is durable and not prone to fail under repeated cyclic loading developed by plunger 416. Should plunger 416, valves 424 and 426, packing unit 444 and gland nut 446, or plunger assembly 524 ever require servicing, such are easy to repair or replace with ordinary tools and without major disassembly of fluid end assembly 410.

While fluid end assemblies 410 and 10 have been described with a high degree of particularity, it will be appreciated that modifications can be made to them. For example, while operating assemblies 410 and 10 with discharge valves 426 and 26 beneath suction valves 424 and 24 is a good idea, especially in freezing weather, since it permits the assemblies to be drained of fluid with a few strokes of plungers 416 and 16, some users may elect to operate assemblies 410 and 10 in an inverted fashion with discharge valves 426 and 26 being positioned above suction valves 424 and 24. Therefore, it is to be understood that my invention is not limited to fluid end assemblies 410 and 10, but encompasses any, and all, fluid end assemblies within the scope of the following claims.

I claim:

1. A pump housing for a fluid end assembly, comprising: a metal forging having: a plunger bore for receiving a reciprocating plunger, said plunger bore being oriented along a first centerline and having a closed inner end and an open outer end; a suction passage intersecting said plunger bore for receiving a suction valve and a valve retainer, said suction passage being oriented along a second centerline that is coplanar with said first centerline and that intersects said first centerline at a reference point so as to define a first obtuse angle, the valve retainer having a tapered inner passageway with an orifice portion of reduced diameter configured to prevent the passage of proppant particles within pumped fluid from blocking the suction valve, the valve retainer is configured to house a portion of a stem of a piston extending through the suction passage and a spring secured to the stern; wherein the tapered inner passageway is positioned upstream of the spring secured to the stem; wherein the tapered inner passageway tapers inwardly along a direction of incoming fluid flow; a discharge passage intersecting both said plunger bore and said suction passage for receiving a discharge valve, said discharge passage being oriented along a third centerline that is coplanar with said second centerline and said first centerline and that intersects said first centerline at said reference point so as to define a second obtuse angle; an outlet passage passing through said metal forging at a right angle to said plunger bore; and, a connector passage intersecting said outlet passage at a right angle and branching between said discharge passage and said outlet passage so as to place said discharge passage in fluid communication with said outlet passage, said outlet passage being positioned so as not to overlap said discharge passage; wherein the position of said outlet passage is configured to limit transverse and lateral flow of fluid through said discharge valve.

2. The pump housing according to claim 1, wherein said suction passage and said discharge passage are each provided with portions of reduced diameter that define valve-supporting decks.

3. The pump housing according to claim 1 wherein a bottom of said suction passage is provided with a first part that tapers at an angle of about 15° relative to said second centerline for receiving a suction valve seat therein and wherein a top of said discharge passage is provided with a second part that tapers at an angle of 15° relative to said third centerline for receiving a discharge valve seat therein.

4. The pump housing according to claim 1 wherein said first obtuse angle measures 120° and said second obtuse angle measures 125°.

5. A fluid end assembly, comprising: a pump housing with: a plunger bore being oriented along a first centerline and having a closed inner end and an open outer end; a suction passage intersecting said plunger bore and being oriented along a second centerline that is coplanar with said first centerline, said suction passage intersecting said first centerline at a reference point so as to define a first obtuse angle; a discharge passage intersecting both said plunger bore and said suction passage, said discharge passage being oriented along a third centerline that is coplanar with said second centerline and said first centerline and that intersects said first centerline at said reference point so as to define a second obtuse angle; an outlet passage passing through said pump housing at a right angle to said plunger bore; and, a connector passage intersecting said outlet passage at a right angle and branching between said discharge passage and said outlet passage so as to place said discharge passage in fluid communication with said outlet passage, said outlet passage being positioned so as not to overlap said discharge passage; a reciprocating plunger being located in said plunger bore; a suction valve being located in said suction passage; a discharge valve being located in said discharge passage; a fluid supply manifold being secured to said pump housing and being in fluid communication with said suction passage; and a valve retainer located within the suction passage upstream of the suction valve, the valve retainer having a tapered inner passageway with an orifice portion of reduced diameter configured to prevent the passage of proppant particles within pumped fluid from blocking the suction valve, the valve retainer is configured to house a portion of a stem of a piston extending through the suction passage and a spring secured to the stem; wherein the tapered inner passageway is positioned upstream of the spring secured to the stem; wherein the tapered inner passageway tapers inwardly along a direction of incoming fluid flow; and wherein the position of said outlet passage is configured to limit transverse and lateral flow of fluid through said discharge valve.

6. The fluid end assembly according to claim 5 wherein said suction passage and said discharge passage are each provided with a portion of reduced diameter that defines a deck for supporting, respectively, said suction valve and said discharge valve within said suction passage and said discharge passage.

7. The fluid end assembly according to claim 5 wherein said first obtuse angle measures 120° and said second obtuse angle measures 125°.

8. The fluid end assembly according to claim 5 further comprising a pony rod attached by means of a pony rod adapter to said plunger for connecting said plunger to a power end of a pump.

9. The fluid end assembly according to claim 5 wherein said suction valve includes a piston having a concave head for providing clearance from said plunger.

10. The fluid end assembly according to claim 5 wherein said discharge valve includes a valve seat for receiving said plunger therein.

11. A fluid end assembly, comprising: a pump housing with: a plunger bore having a closed inner end and an open outer end; a suction passage intersecting said plunger bore; a discharge passage intersecting both said plunger bore and said suction passage such that said discharge passage, said suction passage and said plunger bore radiate outwardly from a common point of intersection to define a shape resembling a "Y"; an outlet passage passing through said pump housing at a right angle to said plunger bore; and, a connector passage intersecting said outlet passage at a right angle and branching between said discharge passage and said outlet passage so as to place said discharge passage in fluid communication with said outlet passage, said outlet passage being positioned so as not to overlap said discharge passage; a reciprocating plunger being located in said plunger bore; a suction valve being located in said suction passage; a discharge valve being located in said discharge passage; a fluid supply manifold being pivotally secured to said pump housing and being in fluid communication with said suction passage; and a valve retainer located within the suction passage upstream of the suction valve, the valve retainer having a tapered inner passageway with an orifice portion of reduced diameter configured to prevent the passage of proppant particles within pumped fluid from blocking the suction valve, the valve retainer is configured to house a portion of a stem of a piston extending through the suction passage and a spring secured to the stem; wherein the tapered inner passageway is positioned upstream of the spring secured to the stem; wherein the tapered inner passageway tapers inwardly along a direction of incoming fluid flow; and wherein the position of said outlet passage is configured to limit transverse and lateral flow of fluid through said discharge valve.

12. The fluid end assembly according to claim 11 wherein said suction passage and said discharge passage are each provided with a portion of reduced diameter that defines a deck for supporting, respectively, said suction valve and said discharge valve therein.

13. The fluid end assembly according to claim 11 wherein a bottom of said suction passage tapers at an angle of 15° for snug engagement with said suction valve and wherein a top of said discharge passage tapers at an angle of 15° for snug engagement with said discharge valve.

14. The fluid end assembly according to claim 11 further comprising a pony rod attached by means of a pony rod adapter to said plunger for connecting said plunger to a power end of a pump.

15. The fluid end assembly according to claim 11 wherein said suction valve includes a piston having a concave head for providing clearance from said plunger.

16. The fluid end assembly according to claim 11 wherein said discharge valve includes a valve seat for receiving said plunger therein.

* * * * *

UNITED STATES PATENT AND TRADEMARK OFFICE

CERTIFICATE OF CORRECTION

PATENT NO. : 8,998,593 B2
APPLICATION NO. : 12/659084
DATED : April 7, 2015
INVENTOR(S) : Vicars It is certified that error appears in the above-identified patent and that said Letters Patent is hereby corrected as shown below:

In the specification

Column 4, Line 54, please delete “2 0”.

Signed and Sealed this
Sixth Day of October, 2015

Michelle K. Lee

Michelle K. Lee
*Director of the United States Patent and Trademark Office*